US005531437A

United States Patent [19]

Coombs

[11] Patent Number: 5,531,437

[45] Date of Patent: Jul. 2, 1996

[54] TELESCOPING REGISTRATION MEMBER FOR SHEET RECEIVERS

[75] Inventor: Peter M. Coombs, Tustin, Calif.

[73] Assignee: Gradco (Japan) Ltd., Tokyo, Japan

[21] Appl. No.: 334,907

[22] Filed: Nov. 7, 1994

[51] Int. Cl.[6] ..... B65H 39/10

[52] U.S. Cl. ..... 271/292; 271/293; 271/220; 270/58.13

[58] Field of Search ..... 271/292, 293, 271/294, 220, 241; 270/53, 58

[56] References Cited

U.S. PATENT DOCUMENTS 4,911,424 3/1990 Lawrence ..... 271/293
4,928,941 5/1990 Uto et al. ..... 270/53
5,350,164 9/1994 Coombs ..... 270/53
5,393,042 2/1995 Coombs et al. ..... 270/53

*Primary Examiner*—David H. Bollinger
*Attorney, Agent, or Firm*—Newton H. Lee, Jr.

[57] ABSTRACT

An in-bin stapling sorter of the type in which the trays are individually and collectively moved vertically relative to a sheet inlet location and opened to provide an enlarged sheet entire space for receiving the sheets, has a jogger which moves the sheets laterally of the sheet infeed direction into edge alignment against an alignment post which is telescopically movable on a fixed support as the trays are collectively moved vertically, but at an angle to the horizontal, the alignment post being disposed substantially normal to the angle of the trays.

4 Claims, 3 Drawing Sheets

TELESCOPING REGISTRATION MEMBER FOR SHEET RECEIVERS

BACKGROUND OF THE INVENTION

In-bin stapling sorters are well known wherein sets of sheets received in the sorter trays are automatically stapled by a stapler which is normally retracted during sorting operations and is moved to a stapling position to automatically apply one or more staples to the set of sheets in the trays.

In the collating of sheets of paper into sets of documents or in segregating sets of sheets in so called sorting machines, it is desired that the sheets forming the sets or documents be aligned or registered to provide a neat package, particularly when the set or document is to be bound or stapled.

In a variety of moving bin sorters, the trays are arranged in a stack of vertically spaced trays which extend horizontally but at an incline from the sheet entry end of the trays, so that the trailing edge of sheets tend to gravitate into alignment against a flange at the lower end of the trays as the sheets are fed into the trays. At the side of the sheets normal to the trailing edge, the sheets may not be closely registered.

Automatic joggers have evolved which are operated to laterally displace sheets in the sorting trays against a standard or vertical wall forming a part of the frame structure for the sorter or against a side flange on the trays.

Such joggers have involved relatively complicated mechanisms and timing means to cause the jogging action in a sorter which otherwise, has been simplified and made of compact form due to the fact that the trays are sequentially opened to provide a large sheet entry space between trays, while otherwise the trays are close together.

An example of such a jogger is illustrated in U.S. Pat. No. 4,928,941, granted May 29, 1990. In this construction, jogging of the sheets to provide neat, edge registered sets is important in that the sets are stapled while in the trays by a stapler moved to a stapling position as the trays containing the sets of sheets are successively moved to the stapler.

In my U.S. Pat. No. 5,350,164, granted Sep. 27, 1994, co-owned herewith, the jogging of sheets is performed as in the case of U.S. Pat. No. 4,928,941 in that the sheets are moved laterally relative to the direction of infeed into the trays as the trays are moved up and down by the tray shifting mechanism.

In the Coombs and Seay U.S. patent application Ser. No. 100,720, filed Aug. 3, 1993, and co-owned herewith, the sheets are registered at the side edges automatically against a side wall opposed to the jogger member responsive to vertical movement of the trays.

A characteristic which is common to the prior art referred to above is that the sorter trays are not only moved between positions above and below a sheet entry space and spaced apart at the sheet entry space to permit entry of a sheet, but, also, all of the trays are raised and lowered in unison on a lower tray support which supports the outer ends of the trays and is raised and lowered by the cams which raise and lower the trays at the sheet entry ends, as more particularly disclosed in Lawrence U.S. Pat. No. 4,911,424, granted Mar. 27, 1990.

As a result of the movement of the sorter trays vertically in the case of the sorters employing in-bin stapling combined with jogging to a side registration surface at one side of the set of trays, in the stapling sorters referred to above, the sheets are caused to be jogged against a vertically extended, stationary alignment surface, thereby causing drag friction on the side edges of the sheets.

In addition, since the trays are vertically shifted relative to a fixed alignment surface provided on a frame the alignment surface may be provided on a member which extends vertically into a region of the sorter which should be unobstructed for safety or aesthetic reasons.

SUMMARY OF THE INVENTION

The present invention provides a very simple and inexpensive solution to aligning the side edges of sheets received in the trays of moving tray sorters.

A telescopic post moves with the trays on a fixed support disposed at an angle from vertical so as to move in a direction substantially normal to the angle of inclination of the trays.

More particularly, an aligning device is disclosed which, as described and claimed in the aforementioned Coombs and Seay application, provides means for automatically aligning the sheets in the trays of the moving tray sorter as the trays are moved, without requiring actuation of a jogging rod or arm, and wherein jogging of the sheets is performed by moving the sheets laterally of the trays into registration with a member which is moved telescopically at an angle normal to the tray surface and in unison with vertical movement of the trays.

Other features and advantages of the invention will be hereinafter described or will become apparent from the following detailed description of the illustrative embodiment shown in the drawings forming a part of this application.

DESCRIPTION OF THE PREFERRED EMBODIMENT

Figure 1:
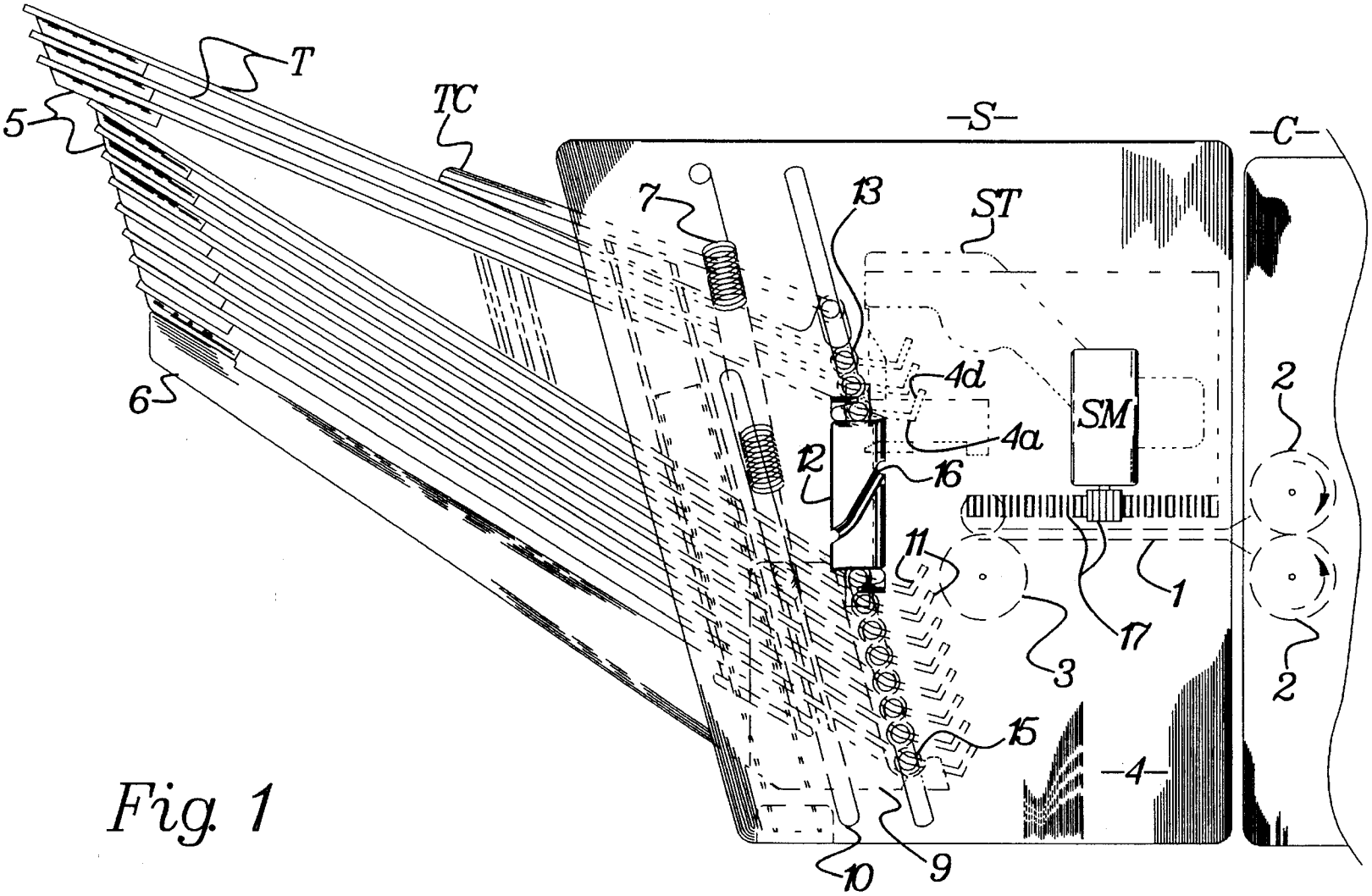
FIG. 1 is a side elevation showing an in-bin stapling sorter incorporating the invention.

As seen in the drawings, referring first to FIG. 1, a sorting machine S is positioned adjacent to a copying or printing machine C. Sheets of paper are fed through a feed path 1 from outlet feed rolls 2 of the copier to infeed rolls 3 of the sorter.

Such a sorter is more particularly disclosed in the aforementioned application of Coombs and Seay. A set of trays T are extended horizontally, but at an incline from the sorter housing 4 and pivotally and slidably rest one on the other at their outer ends 5, except that the outer end of the lower most tray T rests on a bottom tray support 6. Tray support 6 is adapted to move vertically and is biased upwardly at its inner end by a coiled spring 7 connected at its upper end to the housing and at its lower end to a lift frame 9 adapted to move vertically in a guide slot 10, as the inner ends 11 of the trays are caused to move vertically.

Vertical movements of the inner tray ends 11 are caused in response to rotation of a pair of spiral cams 12 at opposite sides of the tray rotatable with shafts 13 adapted to be driven in unison by a reversible drive motor DM and a transversely extended drive shaft 14. Each tray end 11 has a pair of trunnions 15 for engagement in a spiral cam track 16 for opposite movement of the tray ends 11 responsive to opposite rotation of cams 12.

Figure 2:
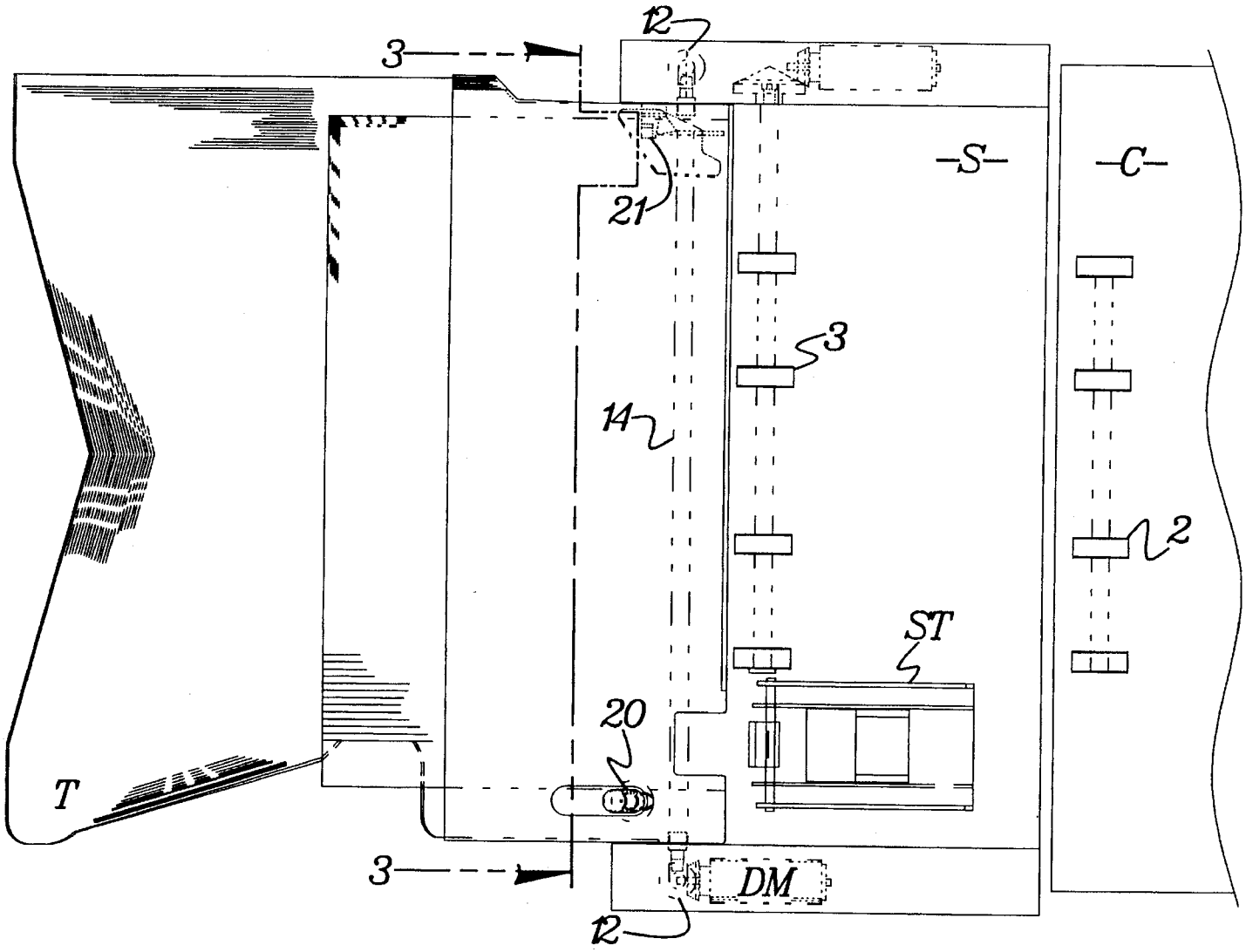
FIG. 2 is a top plan view with the cover removed.

A stapler ST is provided in the housing and is adapted to be shifted by a motor SM and gearing 17 between the retracted non-stapling position of FIG. 2 and a stapling position.

The structure as thus far described, is well known to those skilled in the art and needs no further detailed description.

Means are provided for jogging or aligning sheets of paper between a vertically extended alignment member 20 having a first alignment surface 20*a* at one side of the trays T in response to vertical movement of the trays. The trays are inclined from the horizontal, and member 20 extends substantially normal to the trays.

Various jogging or aligning means may be employed, such as in the above mentioned prior patent.

As shown, however, the jogging or aligning means is like that disclosed in the aforementioned Coombs and Seay application. The aligning or jogging means is denoted at 21 and is in the form of a vertical member 22 located at the opposite side of the trays from the alignment member 20 and, in the illustrative form, extending between upper and lower support blocks 23 adjacent to the side of the trays opposite alignment member 20. In the form shown, the configuration of the member 22, as will be later described, is accommodated by clearance spaces 23*a* formed in the tray. The aligning member 22 may be composed of thin plastic material or light spring steel so as to be flexible or resilient to normally assume the position of FIG. 3 and apply a light force in the direction of the alignment member 20, to sheets or sets of sheets in the trays.

Figure 3:
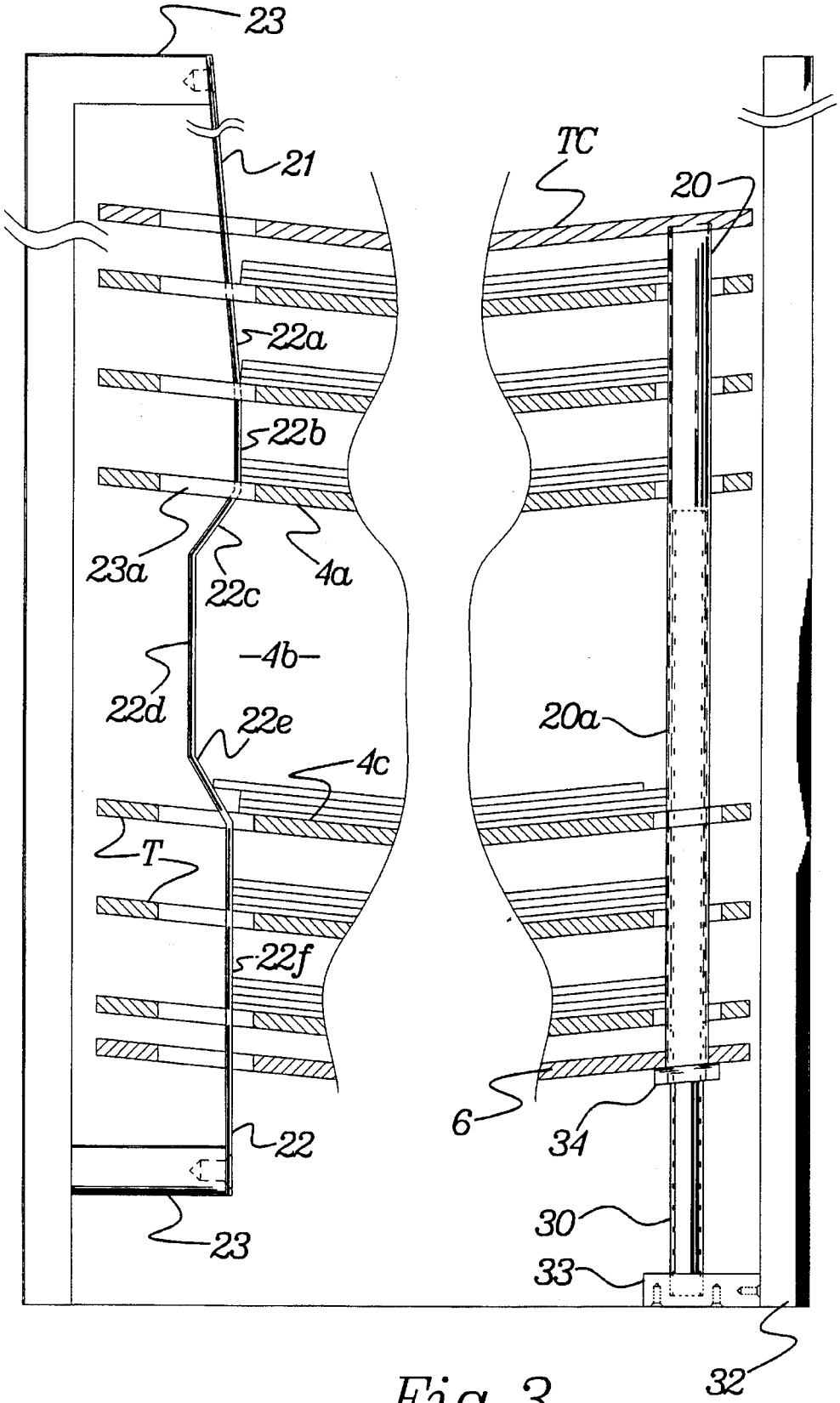
FIG. 3 is an enlarged fragmentary vertical section on the line 3—3 of FIG. 2 showing the operation of the aligning features of the sorter.

Alignment member 22 extends downwardly at a slight angle so as to define with the opposing vertical surface 20*a* a converging space in which the sheets of paper in the trays T, except for the tray designated 4*a* in FIG. 3, are not necessarily in alignment at their respective side edges because of the excess space between surface 20*a* and the portion 22*a* of the alignment member 22.

Tray 4*a* is the first tray above the enlarged sheet entry space 4*b* defined between the tray 4*a* and the tray 4*c* next below the tray 4*a*. At this point it will be understood by those skilled in the art that the space 4*b* is determined by the vertical height of the tray shifting cams 12 described above. It will also be recognized that the sheets entering the trays from the copier or printer are fed to the trays which are successively positioned at the position of tray 4*c*, and depending upon the sheet feeding mechanisms, the last sheet to be received in tray 4*c* may be more or less out of alignment at its side edges, as illustrated by the lateral displacement of the top sheet in tray 4*c*.

The alignment member 22 below the angular section 22*a* has a vertical section 22*b* which opposes the alignment surface 20*a* at the other side of the trays in parallel relation. The vertical height of the vertical section 22*b* is such that the maximum number of sheets forming a set of sheets will be engaged between section 22*b* and the opposite parallel face 20*a*, so that sheets disposed between these parallel members are biased into alignment along their opposite side edges.

Extending downwardly from the alignment member section 22*b* and outwardly away from the opposing face 20*a* and the sheets in the tray is a section 22*c* of the alignment member 22. This section 22*c* provides a wedge angle, so that as successive trays move upwardly from the position of tray 4*c* the uppermost sheet in tray 4*c* will be gently but positively moved laterally into contact with the opposing surface 20*a* of the opposing alignment member 20 so that the sets of sheets in the position of tray 4*a* are moved into edge alignment as illustrated.

In addition, upon reference to FIG. 3, it will be seen that tray 4*a* is in the position in which stapling is performed and therefore stapling is performed while the sheets are in engagement between the vertical section 22*b* of alignment member 22 and the vertical face 20*a* of alignment member 20. Therefore, when the stapler is driven, the sheets will be confined to a neatly stacked set along their side edges, while the trailing edges of the sheets forming the set are aligned against an end flange 4*d* at the lower end of the upwardly inclined tray 4*a*.

The above functions for aligning the sheets are performed by the sections 22*a*, 22*b* and 22*c* of the alignment member 22, responsive to upward movement of the trays T during the sorting operations. In the downward movement of the trays during sorting operations, a similar function is performed by lower sections of the member 22. Thus, extending downwardly from the outwardly angled section 22*c* is a vertical connector section 22*d* at the lower end of which is an inclined section 22*e* extending at an angle towards the opposing face 20*a* of alignment member 20, so that as the illustrated top sheet of the set in the tray 4*c* moves downwardly with such movement of tray 4*c*, those sheets will be gently urged laterally toward the vertically opposing face 20*a* so that the set of sheets in the trays below trays 4*c* are moved into neatly edge aligned sets between the further downwardly extended vertical section 22*f* of member 22 and face 20*a* of the opposing member 20.

As the sorting operation is performed in moving bin sorters of the type here involved, it will be recognized that the sets of sheets as they are progressively increased in numbers are initially aligned by either the alignment member segment sections 22*c* or 22*e*, depending upon the direction of tray movement, vertically up or down relative to sheet inlet location 4*b*. Since in the illustrative embodiment the sets are stapled in the tray 4*a*, during successive downward movement of the entire sets of trays which are moved to their upper most position following the sorting operation for the commencement of the stapling operations, then the sets of sheets are not only pre-aligned before stapling, but any mis-alignment caused by the jostling of the sheets during tray movement is corrected by the light engagement of the sheets between the vertical face 20*a* of the alignment member 20 and a parallel vertical face of the alignment member 22 when the staple is applied.

The jogging means 21 cooperative with the vertical face 20*a* on member 20, though preferably as described and illustrated herein, may have other forms as known in the prior art mentioned above or otherwise.

The essence of the present invention resides in forming the vertical surface 20*a* on a member 20 which telescopes or shifts vertically along with the trays T, but wherein the surface 20*a* on post 20 is disposed, as shown, substantially normal to the inclined trays.

As seen in FIG. 3, movements of the lower tray support 6, in response to rotation of the cams 12 and under the influence of the coil springs 7 which maintain an upward bias on the lower tray support 6, lifts the outer ends of the trays along with their inner ends, which at the inner ends the trays are spaced apart by the cams 12 to provide the sheet entry space.

Member 20 is a hollow or tubular member which telescopes over the upper end of a fixed post 30 and extends through the top tray into abutting engagement beneath a floating upper cover TC disposed across the upper most tray T. Cover TC constitutes a safeguard against easy access to the stapler which is designed to prevent usesr injury. The post 30 is fixed to the base or frame 32 by suitable support 33.

A collar 34 connects the lower end of the telescopic member 20 to the lower tray support 6 so that the two move in unison. In such a construction the telescopic member 20 does not extend above the uppermost tray into either an unsightly or unsafe region above trays or externally of any housing above the trays.

In addition, since the telescopic member 20 is movable at an angle normal to the incline of the trays, along with the lower tray support, during the lateral jogging of the sheets against the face 20*a* by the jogging means 21, the trays, the sheets and the aligning member 20 are all moving in unison in the corresponding direction, thereby avoiding any drag friction between the aligning face 20*a* and the sheets in the trays.

Other variations and modifications of the invention may be made without departing from the scope of the invention as defined in the following claims.

I claim:

1. In an in-bin stapling sorter comprising: a frame structure, a plurality of trays in a vertically spaced and movable stack, means for moving said trays vertically in said frame structure relative to a sheet infeed location to receive sets of sheets, stapling means for stapling sets of sheets in said trays, and alignment means for aligning the side edges of said sets of sheets in said trays, the improvement wherein: said alignment means includes an alignment surface extending vertically at one side of said trays and alignment means are provided at the other side of said trays for jogging sheets into engagement with said alignment surface, said alignment surface being on a member telescopically supported in said frame structure for vertical movement with said tray.

2. An in-bin stapling sorter as defined in claim 1, said means for jogging sheets being a thin flexible member applying a light lateral force to the sheets in the sets of sheets in said trays towards said alignment surface responsive to vertical movement of said trays and said alignment surface.

3. In an in-bin stapling sorter as defined in claim 1, wherein said trays are moved vertically by cooperative cams and cam followers at a sheet inlet end and the other ends of said trays are supported on a lower tray support in response to said, cams and said cam followers to simultaneously raise and lower said other ends of said trays, said member telescopically supported in said frame structure being connected to said lower tray support and movable therewith.

4. In an in-bin stapling sorter as defined in claim 1, said trays being disposed on an incline from the horizontal and said member telescopically supported in said frame structure being disposed at an angle normal to the inclined plane of said trays.

* * * * *